US007954651B2

(12) United States Patent
Kao

(10) Patent No.: US 7,954,651 B2
(45) Date of Patent: Jun. 7, 2011

(54) TOOL RACK

(76) Inventor: Jui-Chien Kao, Tali (TW)

( * ) Notice: Subject to any disclaimer, the term of this patent is extended or adjusted under 35 U.S.C. 154(b) by 0 days.

(21) Appl. No.: 12/551,867

(22) Filed: Sep. 1, 2009

(65) Prior Publication Data

US 2011/0049069 A1 Mar. 3, 2011

(51) Int. Cl.
*A47F 7/00* (2006.01)

(52) U.S. Cl. ..... 211/70.6; 211/94.01; 211/106.01; 248/303

(58) Field of Classification Search ..... 211/94.01, 211/70.6, 106.01; 248/215, 223.4, 225.11, 248/303, 304, 307; 206/349, 372, 373, 376, 206/378
See application file for complete search history.

(56) References Cited

U.S. PATENT DOCUMENTS 2,754,974 A * 7/1956 Larson ..... 211/70.6
3,880,390 A * 4/1975 Niven ..... 248/220.43
4,101,232 A * 7/1978 Haapala ..... 403/261
5,687,856 A * 11/1997 Kendrena ..... 211/70.6
7,100,777 B1 * 9/2006 Kao ..... 211/70.6
7,198,158 B2 * 4/2007 Kao ..... 211/70.6
7,258,239 B2 * 8/2007 Kao ..... 211/70.6
2007/0017886 A1 * 1/2007 Kao ..... 211/94.01
2007/0210021 A1 * 9/2007 Whitehead et al. ..... 211/70.6
2008/0023420 A1 * 1/2008 Kao ..... 211/70.6
2008/0041800 A1 * 2/2008 Kao ..... 211/70.6

* cited by examiner

*Primary Examiner* — Korie Chan
(74) *Attorney, Agent, or Firm* — Apex Juris, pllc; Tracy M Heims

(57) ABSTRACT

A tool rack has a slide rack and multiple hangers. The slide rack has a baseboard and an elongated rail protruding from the baseboard. The multiple hangers are slidably mounted on the rail of the slide rack, and each has a hanging body and a hanging shaft. The hanging body is made by injection molding and slidably connected to the rail of the slide rack and has a protruding side and a connecting mount. The connecting mount protrudes from the protruding side of the hanging body and has an inserting hole formed in the connecting mount. The hanging shaft is metal and has an inserting end and a bent end. The inserting end is mounted in the inserting hole and surrounded by the connecting mount. The bent end is opposite to the inserting end and is bent upward for hanging a hand tool.

6 Claims, 12 Drawing Sheets

TOOL RACK

BACKGROUND OF THE INVENTION

1. Field of the Invention

The present invention relates to a tool rack, and more particularly to a tool rack with multiple hangers of a same size and having sufficient strength to hold hand tools of different sizes.

2. Description of the Prior Art

A conventional tool rack is used to hang and display hand tools, such as box-end wrenches, adjustable wrenches or the like, and has a rail and multiple hangers. The rail is elongated and has a longitudinally axis. The hangers are slidably attached to the rail along the longitudinally axis. Each hanger has a hook for hanging a hand tool. To hang hand tools of different sizes, the hooks of the hangers must be different lengths.

Furthermore, because the hangers are made by injection molding, the hangers have to be made of different length and increase the diameter to promise the strength for hanging the hand tools of different sizes. Therefore, the hangers of different sizes require lot of material for production and increase cost for manufacturing.

To overcome the shortcomings, the present invention provides a tool rack to mitigate or obviate the aforementioned problems.

SUMMARY OF THE INVENTION

The main objective of the invention is to provide a tool rack with multiple hangers of a same size and having sufficient strength to hold hand tools of different sizes.

The tool rack has a slide rack and multiple hangers. The slide rack has a baseboard and a rail being elongated and protruding from the baseboard. The multiple hangers are slidably mounted on the rail of the slide rack, and each has a hanging body and a hanging shaft. The hanging body is made by injection molding and slidably connected to the rail of the slide rack and has a protruding side and a connecting mount. The connecting mount protrudes from the protruding side of the hanging body and has an inserting hole formed in the connecting mount. The hanging shaft is metal and has an inserting end and a bent end. The inserting end is mounted in the inserting hole and surrounded by the connecting mount. The bent end is opposite to the inserting end and has a hook being bent upward for hanging a hand tool.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
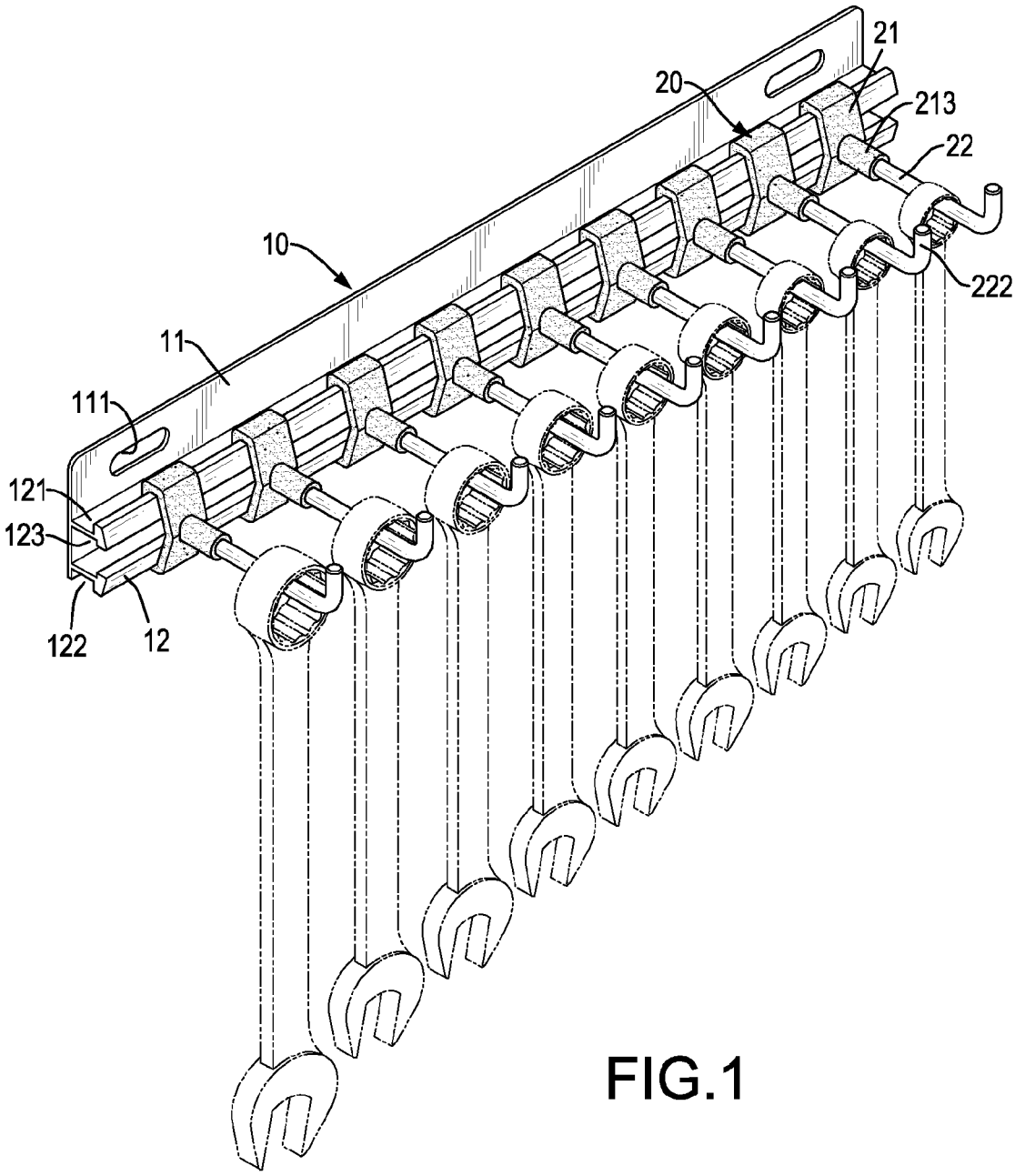
FIG. 1 is a perspective view of a first embodiment of a tool rack in accordance with the present invention.
Figure 2:
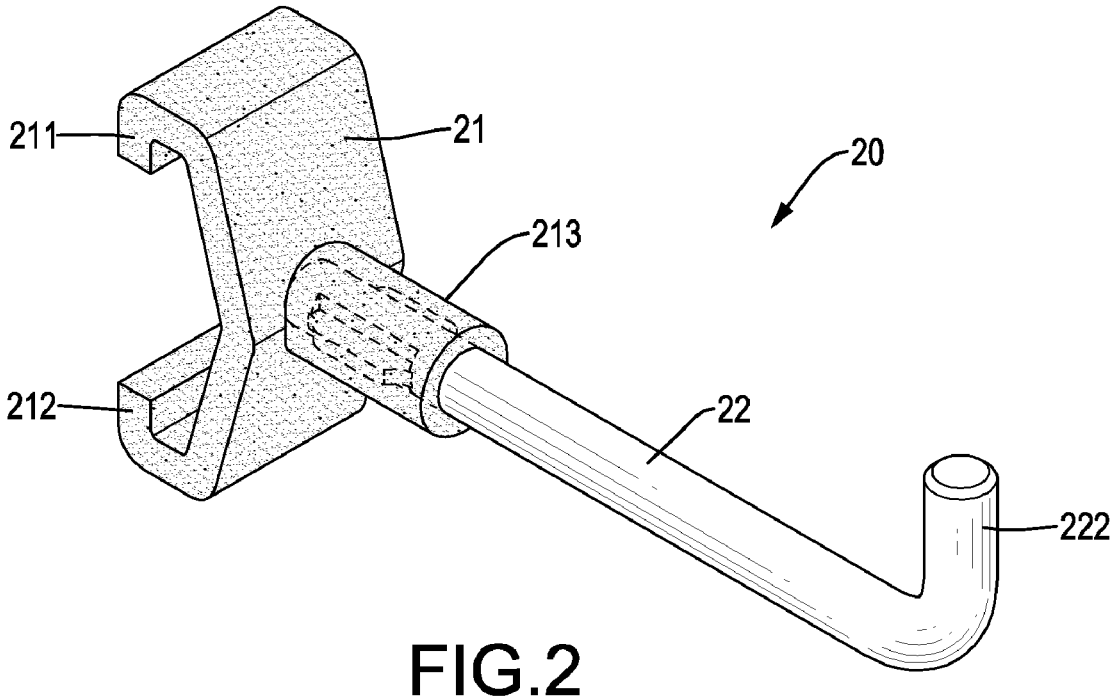
FIG. 2 is a perspective view of a hanger of the tool rack in FIG. 1.
Figure 3:
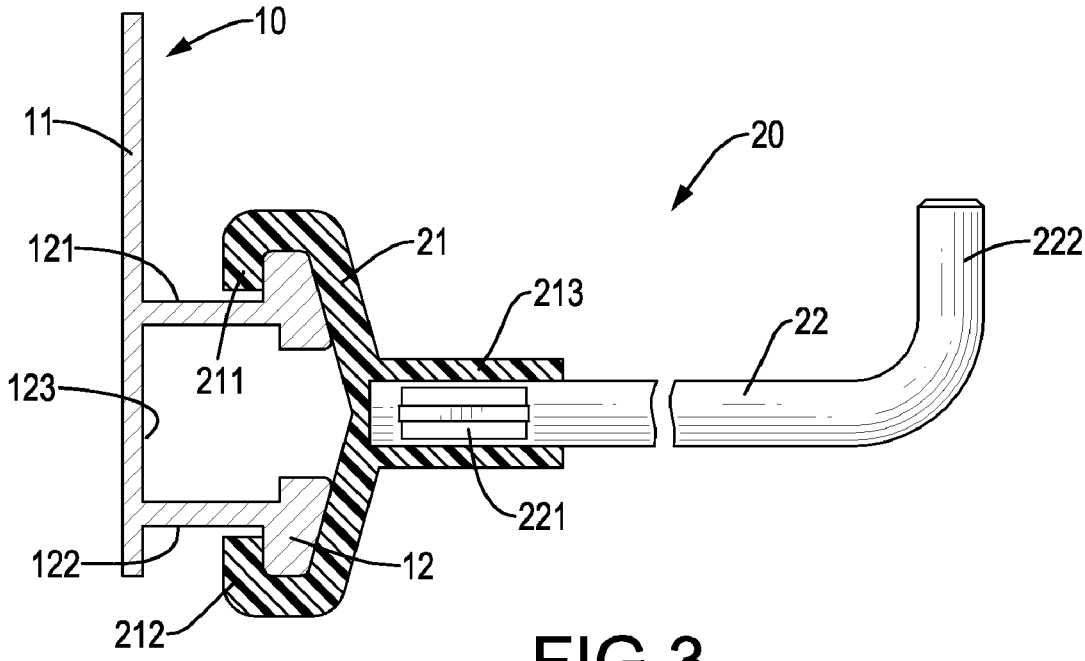
FIG. 3 is a side view in partial section of the tool rack in FIG. 1.

With reference to FIGS. 1 to 4, a first embodiment of a tool rack in accordance with the present invention has a slide rack (10) and multiple hangers (20). The slide rack (10) is an elongated board and has a baseboard (11) and a rail (12). The baseboard (11) is may be rectangular, and has a rear side, a front side, an upper section, a lower section, two ends and two holes (11) respectively formed through and defined near the ends at the upper section of the baseboard (11). The holes (111) are fitted with fasteners, such as screws or bolts to attach the slide rack (10) to a tool board (40), a wall or the like.

The rail (12) is elongated, and is formed on and protrudes perpendicularly from the front side of the baseboard (11), and has two arms (121,122) and a space (123). The arms (121, 122) are parallel to each other and may protrude from the lower section of the baseboard (11), and each arm (121,122) has an engaging end and an engaging rib. The engaging ends of the arms (121,122) are opposite to the baseboard (11) and each engaging end has a thickness. The engaging ribs are respectively formed on the engaging ends of the arms (121, 122) and each engaging rib has a thickness thicker than the thickness of the engaging end. The space (123) is defined between the arms (121,122) to allow the arms (121,122) of the rail (12) to be compressed toward each other.

Each hanger (20) is slidably mounted on the rail (12) of the slide rack (10), and has a hanging body (21) and a hanging shaft (22). The hanging body (21) is made by an injection molding, is connected slidably to the rail (12) of the slide rack (10) and has two hooking arms (211,212), a protruding side and a connecting mount (213).

The hooking arms (211,212) respectively and slidably engage the engaging ribs of the arms (121,122) of the rail (12) to hold the hanging body (21) movably on the slide rack (10). The protruding side of the hanging body (21) is defined on the hanging body (21) opposite to the slide rack (10) and may be an outer side of the hanging body (21). The connecting mount (213) protrudes from the protruding side of the hanging body (21) and may be a hollow rod and extending an axial length along the rod, and has an inserting hole and two engaging recesses. The inserting hole is a blind hole and formed in the connecting mount (213). The engaging recesses are rectangular and radially formed in the connecting mount (213) and communicate with the inserting hole of the connecting mount (213).

The hanging shaft (22) is metal and has an inserting end and a bent end. The inserting end of the hanging shaft (22) is mounted in the inserting hole and surrounded by and covered completely the connecting mount (213), and has two engaging tabs (221). The engaging tabs (221) are formed on and protrude from the inserting end of the hanging shaft (22), may be rectangular, protrude radially from the inserting end of the hanging shaft (22) and align with each other, and may be punched out from the inserting end of the hanging shaft (22). The engaging tabs (221) are mounted in the engaging recesses of the connecting mount (213) and provide an engaging effect for the hanging shaft (22) connected securely to the hanging body (21) to prevent movement or rotation of the hanging shaft (22) relative to the hanging body (21). The bent end of the hanging shaft (22) is opposite to the inserting end, and has a hook (222) bent upward for hanging a hand tool.

Figure 4:
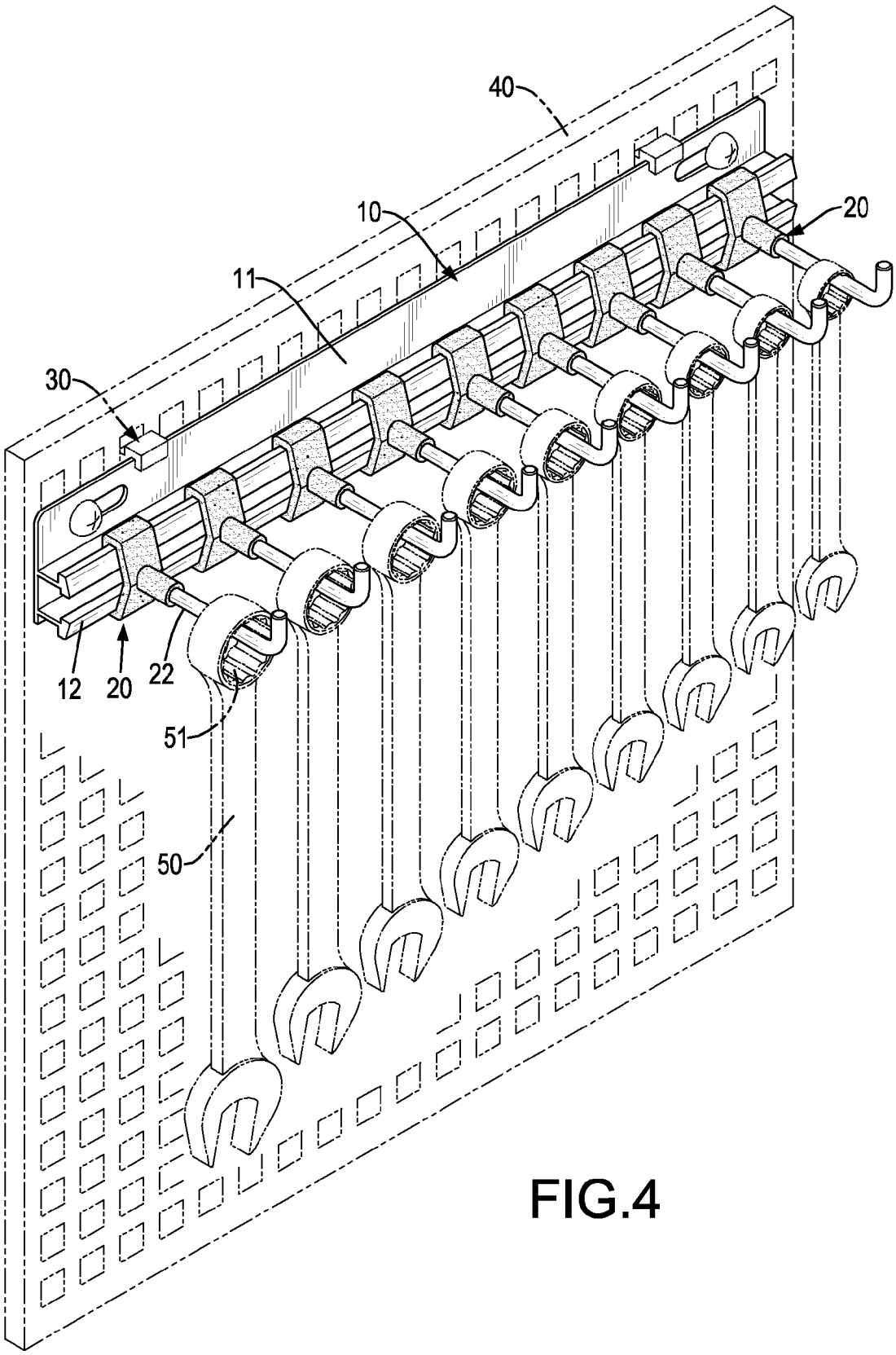
FIG. 4 is perspective view of the tool rack in FIG. 1, shown attached to a tool board.
Figure 5:
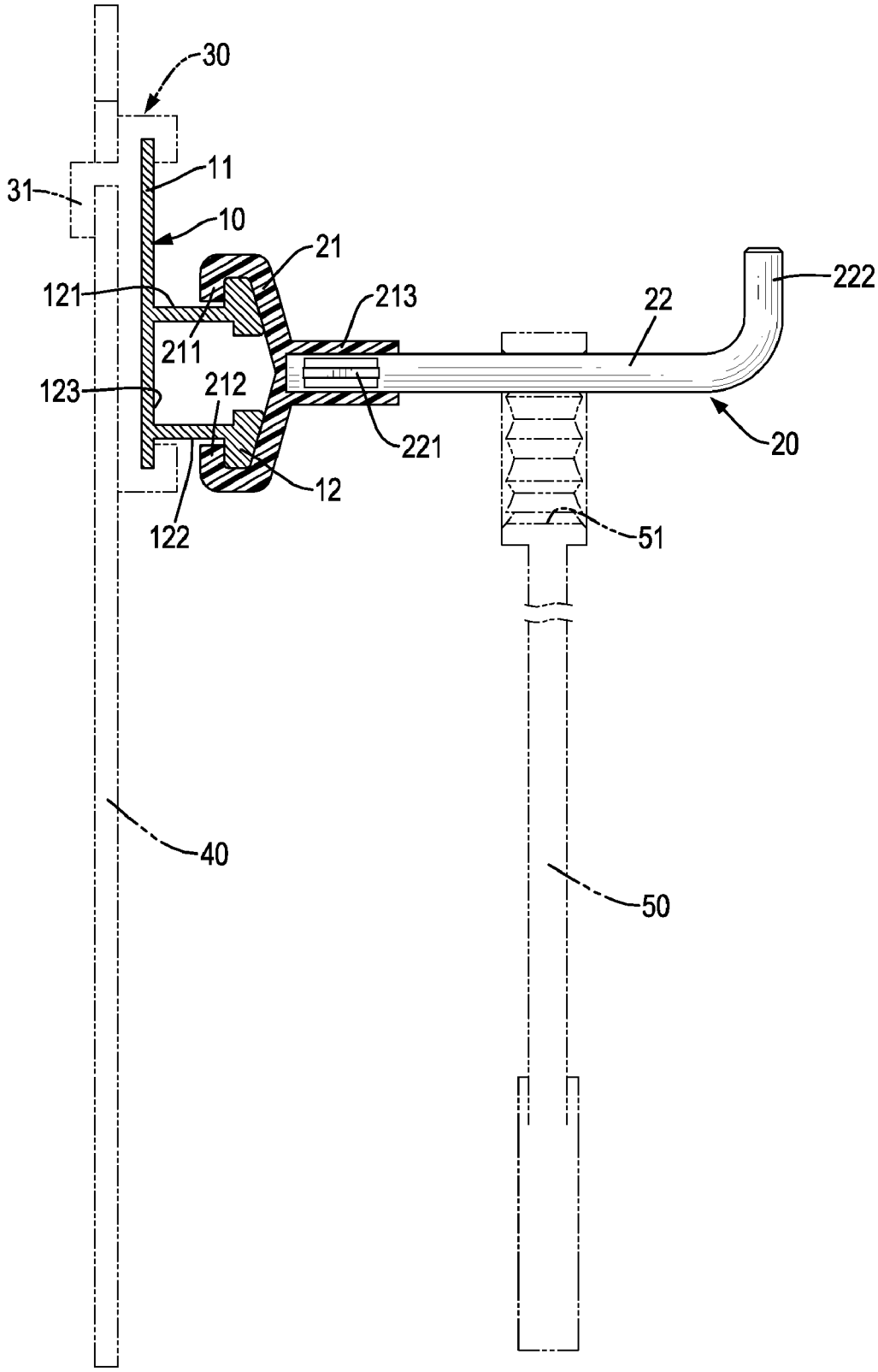
FIG. 5 is a side view in partial section of the tool rack in FIG. 4.

With reference to FIG. 4 and FIG. 5, the slide rack (10) may be attached to the tool board (40) by two connectors (30). The connectors (30) are respectively mounted on the rear side of and clamp on the upper section and the lower section respectively near the ends of the baseboard (11), and each connector (30) has a connecting hook (31) formed opposite to the slide rack (10) and hung on the tool board (40). When the tool rack is set on the tool board (40), the hangers (20) may be slid along the rail (12) and hang hand tools, such as wrenches or box-end wrenches thereon.

Because the hanging shaft (22) of the hangers (20) are metal and the hanging bodies (21) for holding the inserting ends of the hanging shafts (22) are made by injection molding, the hangers (20) have reduced weight and excellent strength for hanging hand tools. Furthermore, to increase strength of the tool rack, the connecting mount (213) of each hanging body (21) is shaped as a collar extending toward the bent end of the hanging shaft (22) and mounted securely around the inserting end of the hanging shaft (22).

Figure 6:
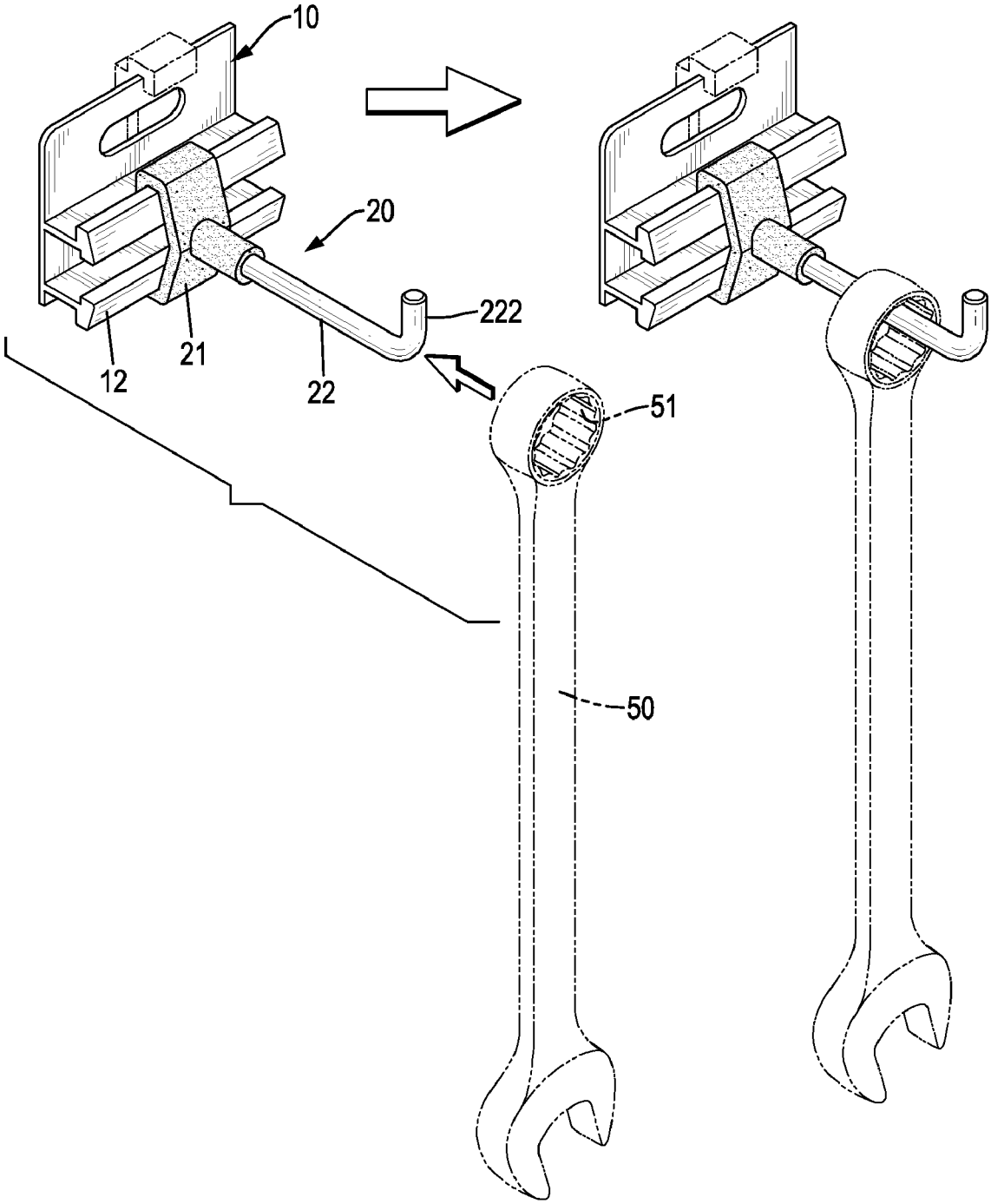
FIG. 6 are operational perspective views of the tool rack in FIG. 1 for hanging a wrench.
Figure 7:
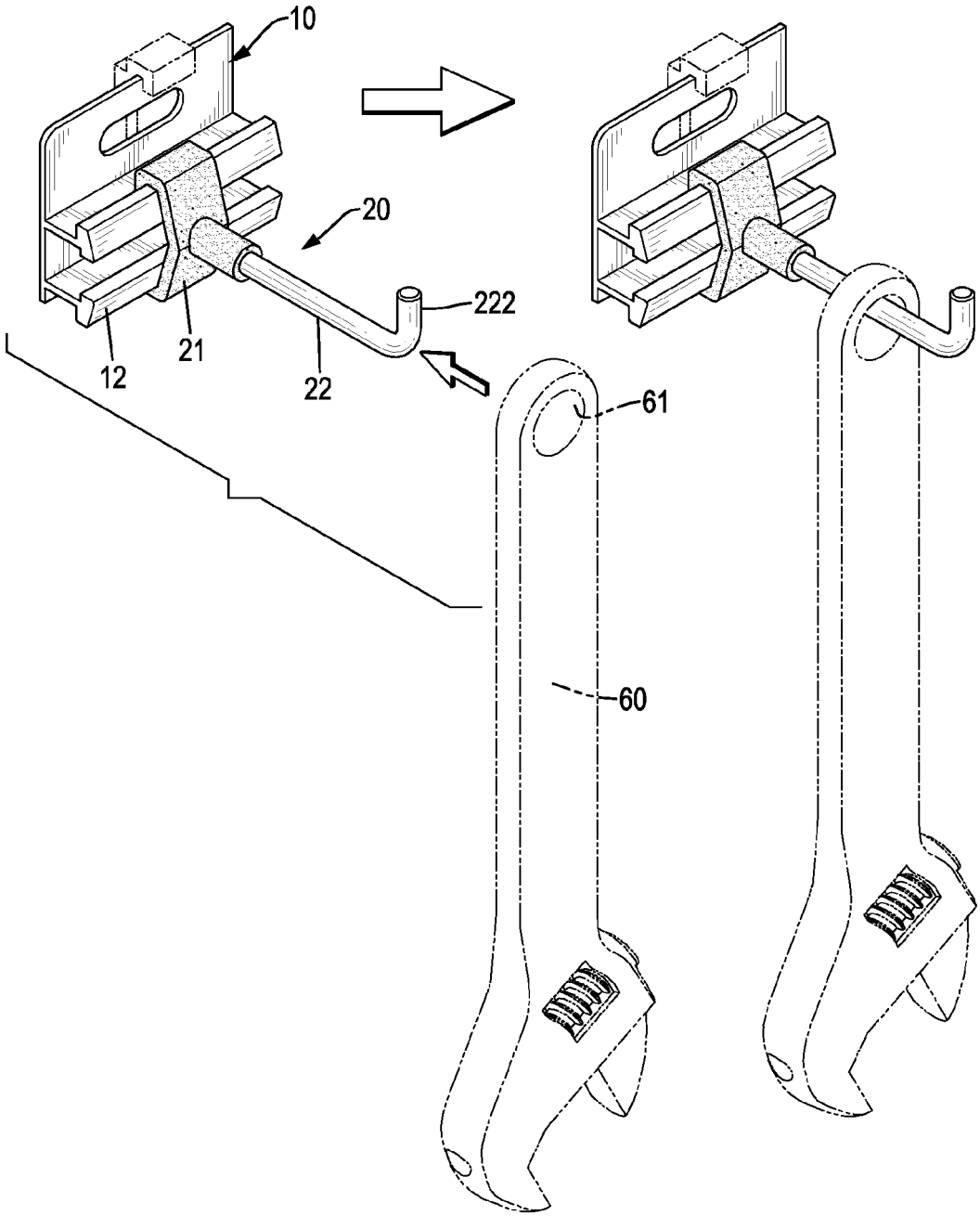
FIG. 7 are operational perspective views of the tool rack in FIG. 1 for hanging an adjustable wrench.

With reference to FIG. 6 and FIG. 7, when the first embodiment of the tool rack is in use, a wrench head (51) of a wrench (50) or a hanging hole (61) of an adjustable wrench may be mounted on and around the hanging shaft (22) of one of the hangers (20). Because the hanging shaft (22) of each hanger (20) is metal and has an excellent structural strength to connect to the hanging body (21), the hanging shaft (22) provides sufficient strength to hold large or heavy hand tools even when the hanging shaft (22) is prolonged or reduced in diameter.

Figure 8:
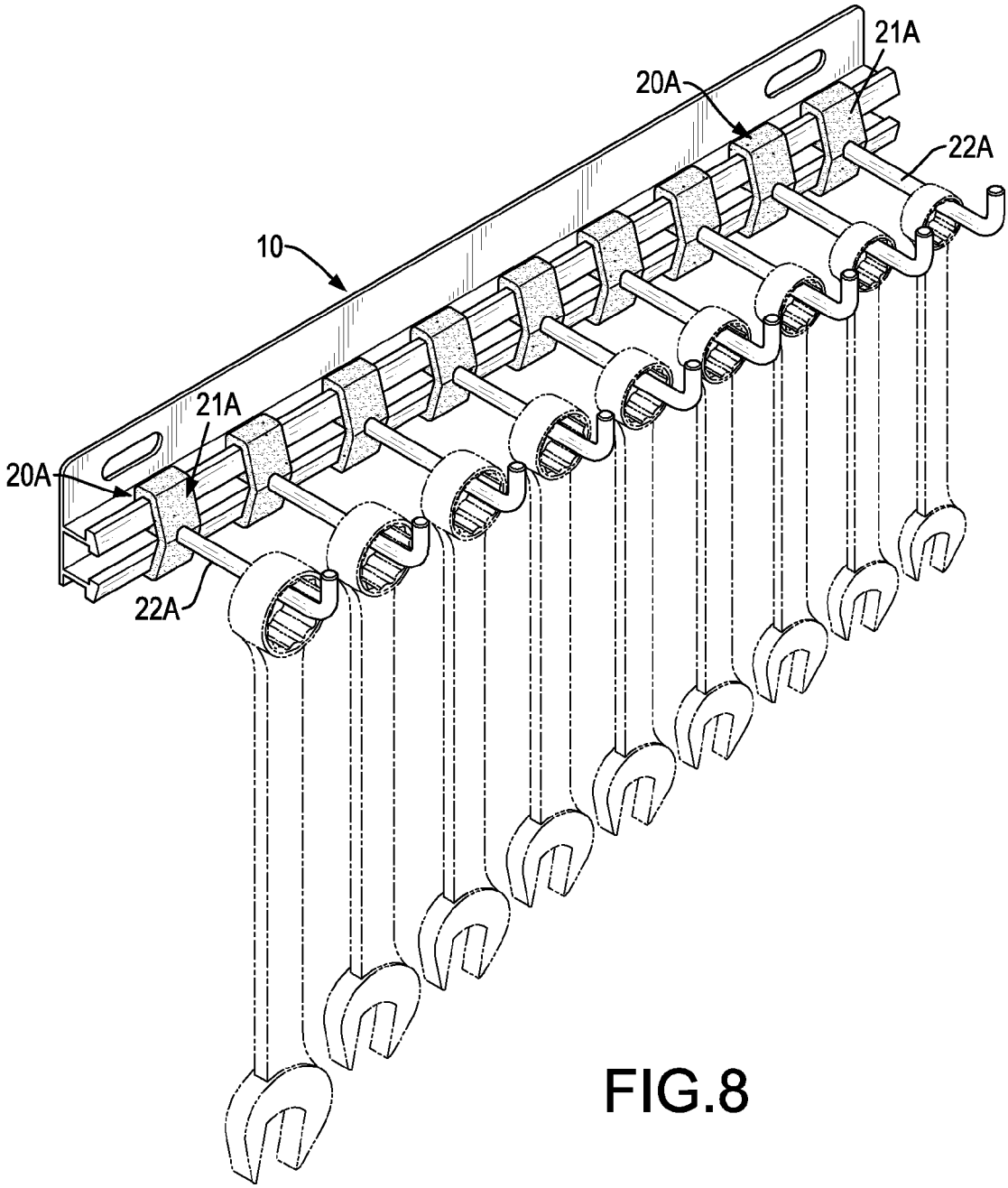
FIG. 8 is a perspective view of a second embodiment of a tool rack in accordance with the present invention.
Figure 9:
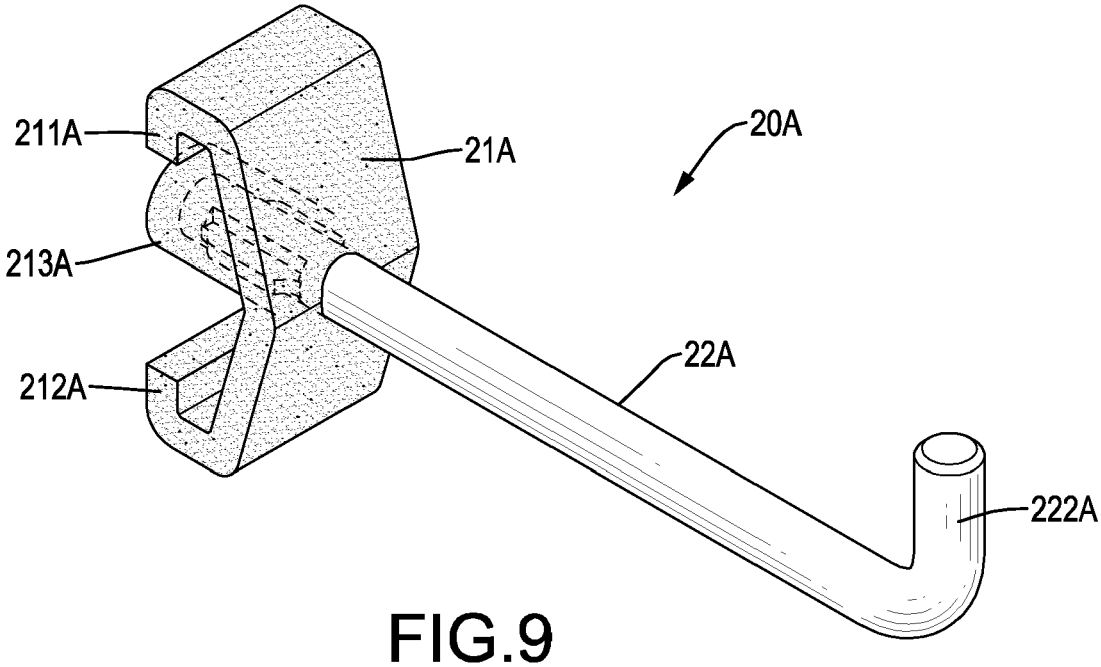
FIG. 9 is a perspective view of a hanger of the tool rack in FIG. 8.
Figure 10:
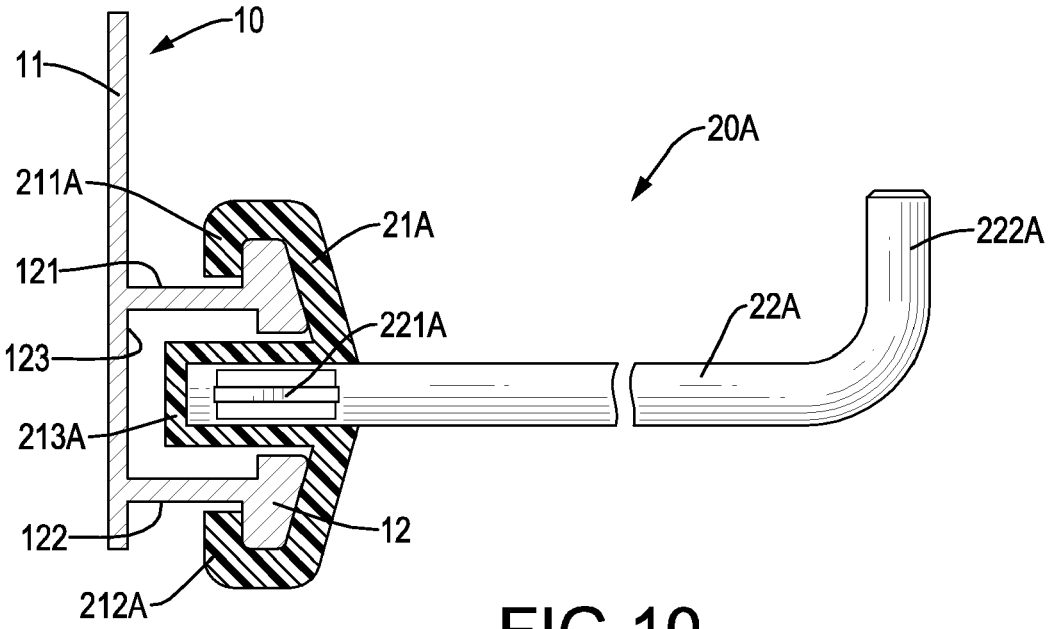
FIG. 10 is a side view in partial section of the tool rack in FIG. 8.

With reference to FIGS. 8 to 10, the second embodiment of a tool rack in accordance with the present invention differs from the first embodiment in the shapes of the hangers (20A). In the second embodiment, each hanger (20A) has a hanging body (21A) and a hanging shaft (22A). The hanging body (21A) is made by injection molding, is connected slidably to the rail (12), and has two hooking arms (211A, 212A), a protruding side, an outer side and a connecting mount (213A).

The hooking arms (211A, 212A) respectively and slidably engage the engaging ribs of the arms (121,122) of the rail (12) to hold the hanging body (21A) movably on the slide rack (10). The protruding side of the hanging body (21A) faces to the slide rack (10), and may be an inner side of the hanging body (21A). The outer side of the hanging body (21A) is opposite to the protruding side and the slide rack (10). The connecting mount (213A) protrudes from the protruding side of the hanging body (21A), extends into the space (123), may be a hollow rod and extending an axial length along the rod, and has an inserting hole and two engaging recesses. The inserting hole is a blind hole formed in the connecting mount (213A) through the outer side of the hanging body (21A). The engaging recesses are rectangular and radially formed in the connecting mount (213A) and communicate with the inserting hole of the connecting mount (213A).

The hanging shaft (22A) of each hanger (20A) is metal and has an inserting end and a bent end. The inserting end of the hanging shaft (22A) is mounted in and surrounded by and covered completely the connecting mount (213A) through the outer side and the protruding side of the hanging body (21A), and has two engaging tabs (221A). The engaging tabs (221A) are formed on and protrude from the inserting end of the hanging shaft (22A), and may be rectangular, protrude radially from the inserting end of the hanging shaft (22A), align with each other, and may be punched out from the inserting end of the hanging shaft (22A). The engaging tabs (221A) are mounted in the engaging recesses of the connecting mount (213A) and provide an engaging effect for the hanging shaft (22A) connected securely to the hanging body (21) to prevent movement or rotation of the hanging shaft (22A) relative to the hanging body (21A). The bent end of the hanging shaft (22A) is opposite to the inserting end, and has a hook (222A) bent upward for hanging a hand tool.

Figure 11:
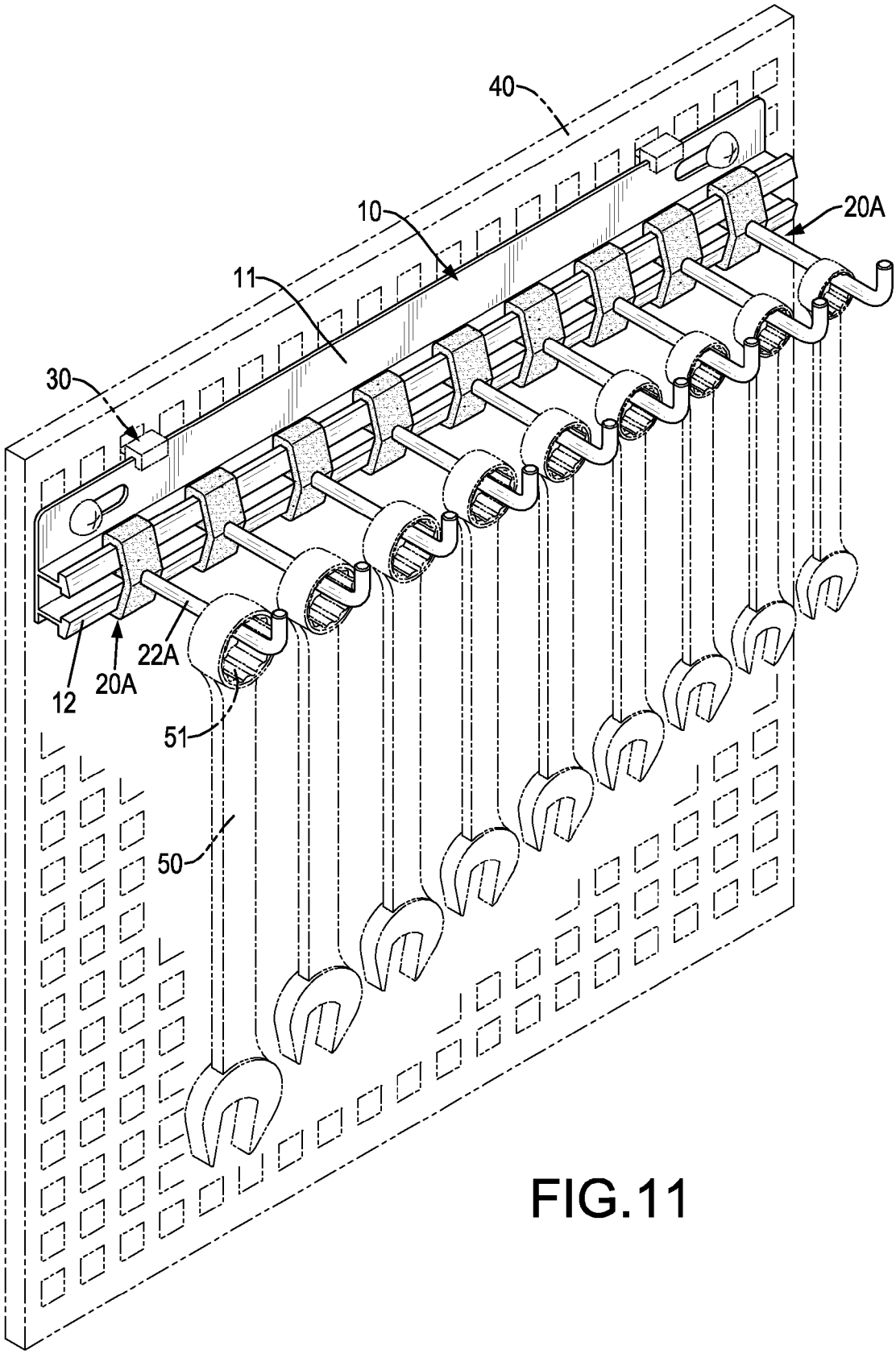
FIG. 11 is a perspective view of the tool rack in FIG. 8 shown attached to a tool board.
Figure 12:
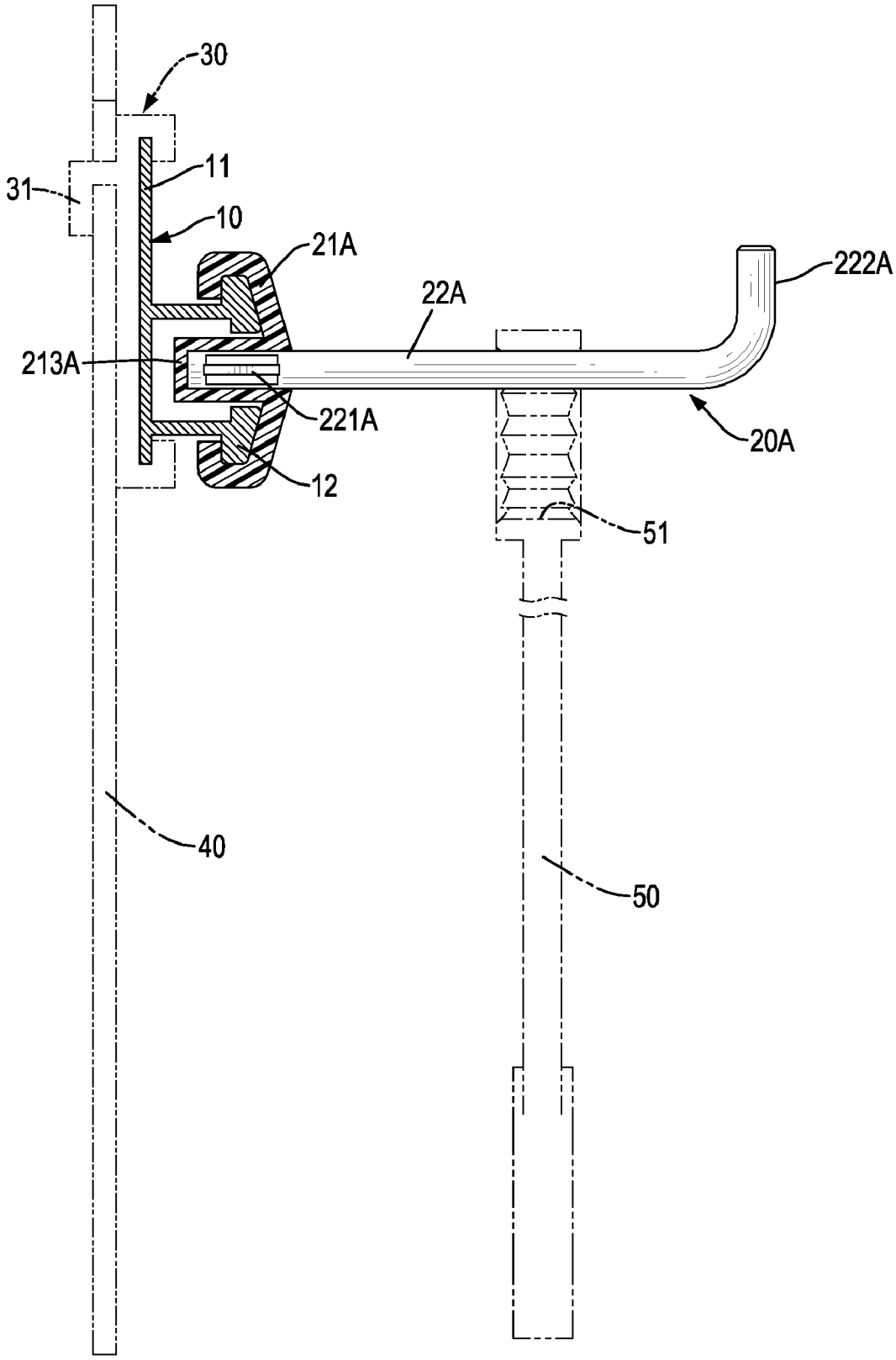
FIG. 12 is a side view in partial section of the tool rack in FIG. 11.

With reference to FIG. 11 and FIG. 12, the tool racks of the second embodiments is used in a similar way to the first embodiments.

Furthermore, the second embodiment of the tool rack has the hanging shafts (22A) respectively mounted in the inserting holes of the connecting mounts (213A) through the outer side and the protruding side of the hanging bodies (21A) to provide a further enhanced strength.

Figure 13:
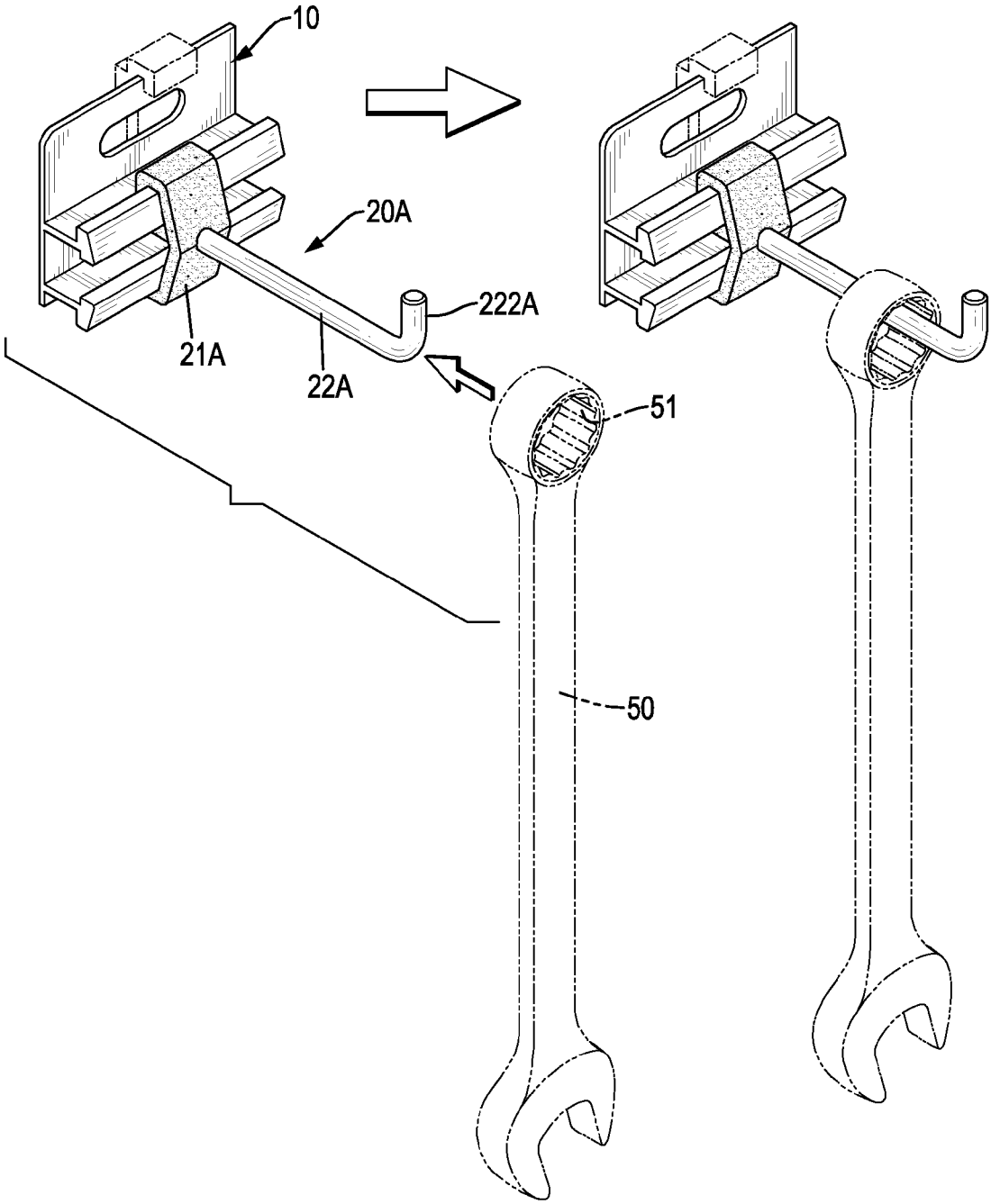
FIG. 13 are operational perspective views of the tool rack in FIG. 8 for hanging a wrench.
Figure 14:
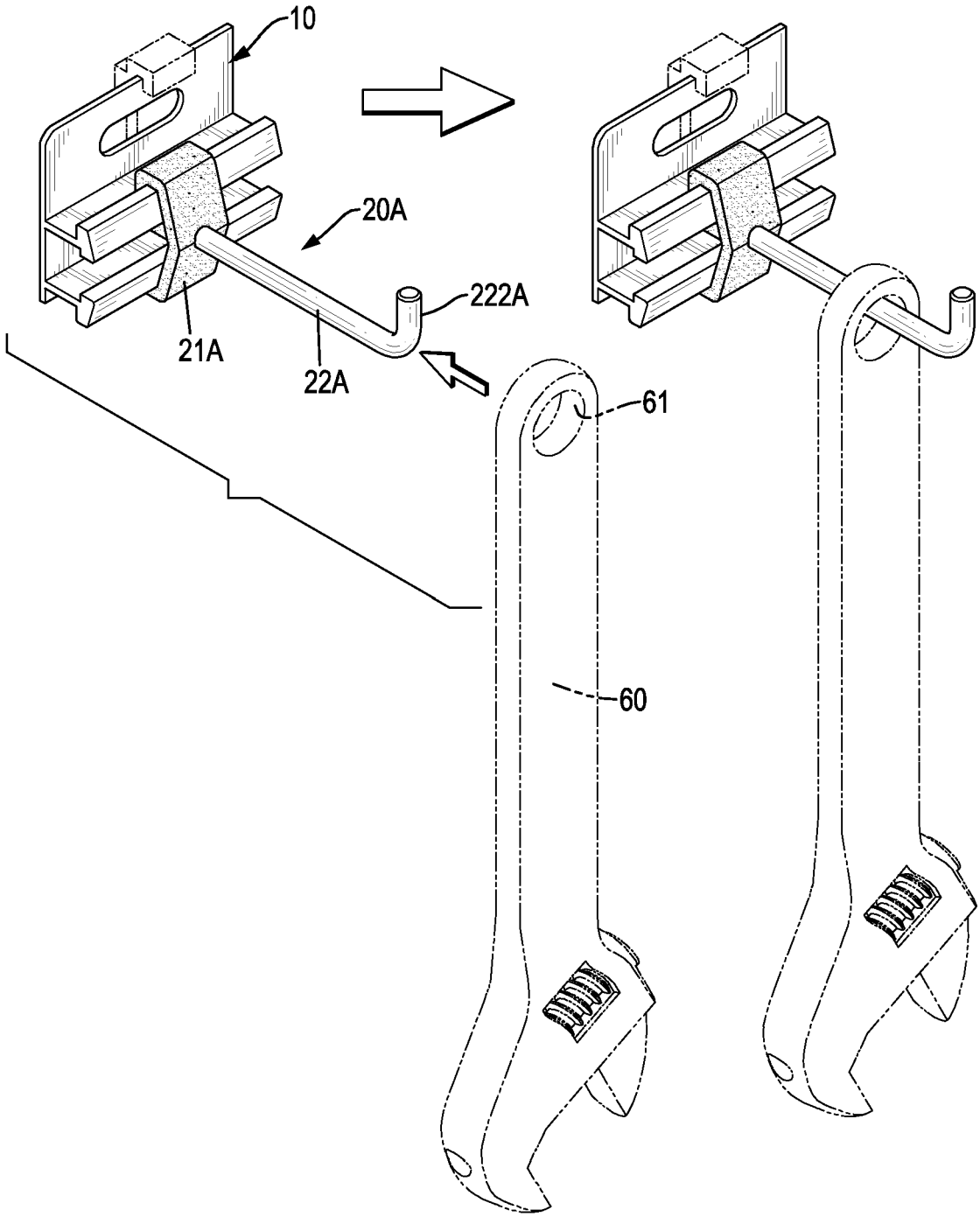
FIG. 14 are operational perspective views of the tool rack in FIG. 8 for hanging an adjustable wrench.

With reference to FIG. 13 and FIG. 14, when the second embodiment of the tool rack is in use, a wrench head (51) of a wrench (50) or a hanging hole (61) of an adjustable wrench may be mounted on and around the hanging shaft (22A) of the hanger (20A). Because the hanging shaft (22A) of each hanger (20) is metal and has an excellent structural strength to connect to the hanging body (21), the hanging shaft (22) provides sufficient strength to hold a large or heavy hand tool even when the hanging shaft (22) is prolonged or reduced in diameter.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A tool rack comprising a slide rack having a baseboard; and a rail being elongated and protruding from the baseboard;

multiple hangers slidably mounted on the rail of the slide rack and each having a hanging body made by injection molding and slidably connected to the rail of the slide rack and having a protruding side defined on the hanging body; and a rod connecting mount protruding from the protruding side of the hanging body and extending an axial length along the rod and having an inserting hole being a blind hole formed in the connecting mount; and an engaging recess formed in the connecting mount and communicating with the inserting hole of the connecting mount; and a hanging shaft made of metal and having an inserting end mounted in the inserting hole and surrounded and covered completely by the connecting mount having a rectangular engaging tab formed on and protruding radially from the inserting end of the hanging shaft and mounted in the engaging recess of a corresponding connecting mount; and a bent end opposite to the inserting end and having a hook bent upward for hanging a hand tool.

2. The tool rack as claimed in claim 1, wherein the protruding sides of hanging bodies are opposite to the slide rack; and each connecting mount protrudes toward the bent end of the hanging shaft which is mounted in the connecting mount.

3. The tool rack as claimed in claim 1, wherein the baseboard is elongated;

the rail has two arms respectively protruding from the baseboard, and each having an engaging end opposite to the baseboard and having a thickness; and an engaging rib formed on the engaging end and having a thickness thicker than the thickness of the engaging end; and a space defined between the arms;

each hanging body further has an outer side opposite to the protruding side and two hooking arms respectively and slidably engaged the engaging ribs of the arms;

the protruding sides of the hanging bodies face to the slide rack;

the connecting mounts of the hanging bodies respectively protrude from the protruding sides of the hanging bodies and extend into the space of the rail; and the inserting ends of the hanging shafts are respectively mounted through the outer sides and the protruding sides of the hanging bodies and are mounted in and surrounded by the connecting mounts of the hanging bodies.

4. The tool rack as claimed in claim 1, wherein the baseboard is an elongated rectangular board and further has a front;

an upper section;

a lower section;

two ends; and two holes respectively formed through and defined near the ends at the upper section of the baseboard; and the rail is formed on and protrudes from the front and the lower section of the baseboard.

5. The tool rack as claimed in claim 2, wherein the baseboard is an elongated rectangular board and further has a front;

an upper section;

a lower section;

two ends; and two holes respectively formed through and defined near the ends at the upper section of the baseboard; and the rail is formed on and protrudes perpendicularly from the front and the lower section of the baseboard.

6. The tool rack as claimed in claim 3, wherein the baseboard is an elongated rectangular board and further has a front;

an upper section;

a lower section;

two ends; and two holes respectively formed through and defined near the ends at the upper section of the baseboard; and the rail is formed on and protrudes perpendicularly from the front and the lower section of the baseboard.

* * * * *